United States Patent [19]

Ikeda et al.

[11] Patent Number: 4,742,041

[45] Date of Patent: May 3, 1988

[54] HEAT-SENSITIVE RECORDING MATERIAL

[75] Inventors: Kensuke Ikeda; Hirofumi Mitsuo; Junichi Yoneda, all of Shizuoka, Japan

[73] Assignee: Fuji Photo Film Co., Ltd., Kanagawa, Japan

[21] Appl. No.: 878,756

[22] Filed: Jun. 26, 1986

[30] Foreign Application Priority Data

Jun. 26, 1985 [JP] Japan ..... 60-139868

[51] Int. Cl.[4] ..... B41M 5/18

[52] U.S. Cl. ..... 503/200; 427/152; 503/214; 503/216; 503/226

[58] Field of Search ..... 346/200, 226; 427/150–152; 503/214, 216, 217, 221, 225, 200, 226

[56] References Cited

U.S. PATENT DOCUMENTS 4,513,301 4/1985 Takayama et al. ..... 346/226

FOREIGN PATENT DOCUMENTS 6126193 10/1981 Japan ..... 346/200

0045191 3/1984 Japan ..... 346/200

*Primary Examiner*—Bruce H. Hess

*Attorney, Agent, or Firm*—Sughrue, Mion, Zinn, Macpeak, and Seas

[57] ABSTRACT

A novel heat-sensitive recording material comprising a support having coated thereon a heat-sensitive coloring layer containing a colorless or light-colored electron donor dye precursor and an electron acceptor compound which colors upon reaction with said electron donor dye precursor and a protective alyer coated on the heat-sensitive coloring layer comprising a saponified product of a vinyl acetate-acrylamide copolymer or vinyl acetate-methacrylamide copolymer having an acrylamide or methacrylamide content of about 0.5 to about 80% by weight.

11 Claims, No Drawings

HEAT-SENSITIVE RECORDING MATERIAL

FIELD OF THE INVENTION

The present invention relates to a heat-sensitive recording material. More particularly, the present invention relates to a heat-sensitive recording material which utilizes the color reaction of a colorless or light-colored electron donor dye precursor and an electron acceptor compound.

BACKGROUND OF THE INVENTION

So-called two component system heat-sensitive recording materials which utilize the color reaction of a colorless or light-colored electron donor dye precursor and an electron acceptor compound are disclosed in Japanese Patent Publication Nos. 14039/70 and 4160/68. Two component coloring system heat-sensitive recording materials are prepared by applying to a support a mixture of a fine dispersion of a colorless or light-colored electron donor dye precursor, an electron acceptor compound, a binder and the like in such a manner that the two heat-reactive compounds are kept separated by the binder and the like. When heated, one or both of the two compounds are melted and brought into contact with each other whereupon they undergo a color reaction which is used for recording. These two component coloring system heat-sensitive recording materials are advantageous and practical in that their primary coloring mechanism eliminates the need for development, that their paper quality resembles that of normal papers, that they are convenient to handle, that the color density is high, and that heat-sensitive recording materials having various color hues can be easily prepared. Therefore, these heat-sensitive recording materials are most widely used as heat-sensitive recording materials. In recent years, these heat-sensitive recording materials have shown a remarkable increase in use with facsimile, recorders and printers. As facsimiles have been used more and more, the recording speed has been improved. This has required the heat-sensitive recording material to color with shorter pulses, i.e. lower energy, that is, to have an improved heat-response.

On the other hand, these heat-sensitive recording materials are disadvantageous in that the primary coloring mechanism is such that a reaction of the electron donor dye precursor and the electron acceptor compound also occurs due to solvents or the like even without applying heat.

This is because all heat-sensitive recording materials of this type are made of organic materials which are highly soluble in solvents and thus cause a reaction therein. Accordingly, when solvents such as water ink pen, oil ink pen, fluorescent pen, diazo developer, adhesives, or paste are brought in contact with stationery, the background having white color of the heat-sensitive recording material may color or printed portions thereof may discolor, thereby impairing commercial value.

Attempts have been made to provide a solvent-resistant protective layer on the heat-sensitive coloring layer as disclosed in Japanese Patent Publication No. 27880/69, and Japanese Patent Application (OPI) Nos. 30437/73 and 31958/73 (the term "OPI" as used herein means an "unexamined published application"). However, such a protective layer lowers the coloring sensitivity. Such a protective layer also makes the recording material insufficiently compatible with the heat-sensitive head of the heat-sensitive recording apparatus, causing sticking or noises upon recording. Moreover, the protective layer makes the recording material poor in writing quality as stationery, causing ink run or the like.

SUMMARY OF THE INVENTION

It is therefore an object of the present invention to provide a heat-sensitive recording material excellent in chemical resistance, solvent resistance, compatibility with the heat-sensitive head, and writing quality as stationery.

The above and other objects of the present invention will become more apparent from the following detailed description and examples.

These objects of the present invention are accomplished by a heat-sensitive recording material comprising a support having coated thereon a heat-sensitive coloring layer containing a colorless or light-colored electron donor dye precursor and an electron acceptor compound which colors upon reaction with the electron donor dye precursor, characterized in that a saponified product of a vinyl acetate-acrylamide copolymer or vinyl acetate-methacrylamide copolymer having an acrylamide or methacrylamide content of about 0.5 to about 80% by weight is incorporated in a protective layer provided on the heat-sensitive coloring layer. (The saponified product of the copolymer obtained in accordance with the present invention will be hereinafter referred to as "modified polyvinyl alcohol.")

DETAILED DESCRIPTION OF THE INVENTION

The effective range of the acrylamide or methacrylamide content of the above modified polyvinyl alcohol is about 0.5 to about 80% by weight. If this value is outside the above range, the objects of the present invention cannot be realized. The preferred range is 1 to 70% by weight. Acrylamides substituted with $C_{2-8}$ alkyl groups such as methyl, ethyl, propyl, iso-propyl, butyl, amyl, octyl, etc., show similar effects and are advantageously used with a water-soluble polymer not related to the copolymers of the present invention.

The degree of saponification is preferably about 60 to about 100 mol.%, most preferably 80 to 100 mol.%. The average degree of polymerization is preferably about 100 to about 3,000, most preferably 300 to 2,000. The content of carboxyl groups produced by the saponification reaction of acrylamide is not specifically limited but is most preferably 0.05 to 10 mol.%.

The preparation of the above modified polyvinyl alcohol may be accomplished by any conventional method such as described in Japanese Patent Publication No. 42724/72 corresponding to U.S. Pat. No. 3,672,941 (which is hereby incorporated by reference).

It is desired that a starch is incorporated in a protective layer on the heat-sensitive coloring layer together with the above modified polyvinyl alcohol. Examples of such a starch include modified starch such as oxidized starch, crosslinked starch, graft starch, esterified starch and etherified starch.

In the present invention, the mixing proportion of the above modified polyvinyl alcohol based on the weight of the starch is preferably about 5 to about 70% by weight, most preferably 20 to 60% by weight.

In the present invention, when the above modified polyvinyl alcohol or a mixture of the above modified polyvinyl alcohol and a starch is used as a protective layer, a pigment, a metal soap, a wax, or the like may be incorporated in the protective layer in order to further improve compatibility with the heat-sensitive head.

The amount of the pigment to be added is preferably 0.5 to 4 times, most preferably 0.8 to 3.5 times the total weight of the above starch and modified polyvinyl alcohol. If this value is less than the above lower limit, the compatibility of the protective layer with the heat-sensitive head cannot be improved. If this value exceeds the upper limit, the sensitivity is remarkably reduced, impairing commercial value. Suitable pigments are zinc oxide, calcium carbonate, barium sulfate, titanium oxide, lithopone, talc, agalmatolite, kaolin, aluminum hydroxide, silica, amorphous silica and colloidal silica.

As such a metal soap there may be used higher fatty acid metal soap. An emulsion of zinc stearate, calcium stearate or aluminum stearate may be used. In particular, an emulsion of zinc stearate is suitable. The amount of the metal soap is preferably 0.5 to 20% by weight, most preferably 1 to 10% by weight based on the total weight of the protective layer. A thickness of the protective layer is 0.1 to 10 μm, preferably 0.5 to 5 μm.

As suitable wax there may be used an emulsion of paraffin wax, microcrystalline wax, carnauba wax, methylol aeroamide, stearylamide, polyethylene wax or polystyrene wax. The amount of the wax to be added is preferably about 1 to about 20%, most preferably 1 to 10% by weight, based on the total weight of the protective layer.

When the protective layer is applied to the heat-sensitive coloring layer, a surface active agent may be added thereto in order to provide a uniform protective layer. Suitable surface active agents are sulfosuccinic acid alkali salts or fluorine-containing surface active agents. Specific examples of such surface active agents include sodium salts or ammonium salts of di-(2-ethylhexyl)sulfosuccinic acid and di-(n-hexyl)sulfosuccinic acid. Most anionic surface active agents are effective.

In the present invention, compounds which are normally used as agents for rendering PVA water-resistant may be used for the purpose of rendering the heat-sensitive material water-resistant. Specific examples of such a compound include water-soluble precondensation resins such as N-methylol urea, N-methylol melamine, urea-formalin, melamine-formalin, benzoguanamine-formalin, and acetoguanamine-formalin, dialdehyde compounds such as glyoxazol and glutaraldehyde, inorganic crosslinking agents, and blend heat-treating agents such as polyacrylic acid, methylvinyl, ether-maleic acid copolymer and isobutylene-maleic anhydride. The amount of the agent for rendering the heat-sensitive material water-resistant to be used is preferably about 0.5 to about 30% by weight based on the weight of the modified polyvinyl alcohol.

As the colorless or light-colored electron donor dye precursor of the present invention there may be used triaryl methane compounds, diphenyl methane compounds, xanthene compounds, thiazine compounds, or spiropyran compounds. Specific examples of such electron donor dye precursors include those described in Japanese Patent Application (OPI) No. 27253/80. Examples of these electron donor dye precursors are triaryl methane compounds such as 3,3-bis(p-dimethylaminophenyl)-6-dimethylaminophthalide (i.e. crystal violet lactone), 3,3-bis(p-dimethylaminophenyl)phthalide, 3-(p-dimethylaminophenyl)-3-(1,3-dimethylindol-3-il)phthalide, and 3-(p-dimethylaminophenyl)-3-(2-methylindol-3-il)phthalide, diphenyl methane compounds such as 4,4'-bis-dimethylaminobenzhydrinebenzylether, N-halophenyl-leuco Auramine, and N-2,4,5-trichlorophenyl leuco Auramine, xanthene compounds such as rhodamine-B-anilinolactam, rhodamine(p-nitrino) lactam, 2-(dibenzylamino)fluorane, 2-phenylamino-6-diethylamino fluorane, 2-(o-chloroanilino)-6-diethylamino fluorane, 2-(3,4-dichloroanilino)-6-diethylamino fluorane, 2-anilino-3-methyl-6-piperidino fluorane, and 2-phenyl-6-diethylamino fluorane, thiazine compounds such as zenzoyl leucomethylene blue, p-nitrobenzyl leucomethylene blue, and spiro compounds such as 3-methyl-spirodinaphthopyran, 3-ethyl-spirodinaphthopyran, 3,3'-dichloro-spiro-dinaphthopyran, 3-benzylspiro-dinaphthaopyran, 3-methyl-naphtho-(3-methoxybenzo)-spiropyran and 3-propyl-spiro-dibenzopyran. These compounds may be used singly or in combination. Triaryl methane compounds such as crystal violet lactone and xanthene compounds provide less fog and, hence, higher color density and, thus, are preferable electron donor dye precursors. More preferred electron donor dye precursors include xanthene compounds of the general formula (II):

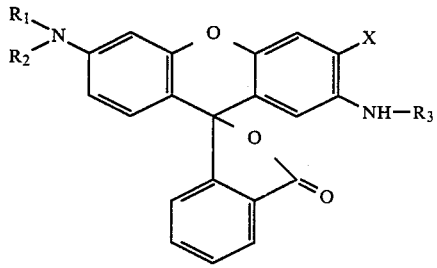

(II)

wherein $R_1$ and $R_2$, which may be the same or different, each represent a $C_{1-10}$ alkyl group or cycloalkyl group which may be substituted; $R_3$ represents an aryl group which may be substituted; and X represents a $C_{1-10}$ alkyl group which may be substituted or a halogen atom.

In the general formula (II), the alkyl group represented by $R_1$ and $R_2$ may be either straight-chain or branched, and may optionally have substituent groups. The aryl group represented by $R_3$ preferably has 6 to 20 carbon atoms and is preferably a phenyl group or phenyl group having substituent groups. Such substituent groups are preferably $C_{1-10}$ alkyl groups.

Particularly preferred among the dye precursors of the general formula (II) are those represented by the general formula (III):

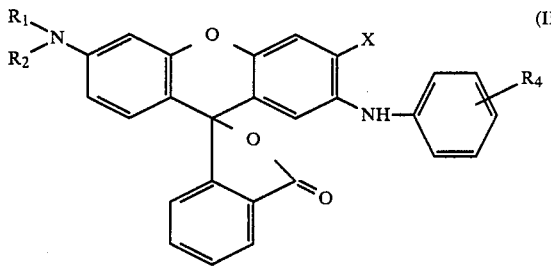

(III)

wherein $R_1$ and $R_2$, which may be the same or different, each represents a $C_{1-10}$ alkyl group which may be substituted; $R_4$ represents a hydrogen atom or $C_{1-8}$ alkyl group, preferably hydrogen atom or lower alkyl group, particularly $CH_3$; and X represents a $C_{1-8}$ alkyl group or a chlorine atom.

In the general formula (III), the alkyl group represented by $R_1$ and $R_2$ may form a ring and may have substituent groups.

In the general formula (III), X is most preferably a methyl group or chlorine atom.

As these colorless or light-colored electron donor dye precursors there may be used the following compounds. However, the present invention is not limited thereto.

Specifically, these electron donor dye precursors include 2-anilino-3-methyl-6-dimethylamyl fluoran, 2-anilino-3-methyl-6-N-methyl-N-ethylamino fluoran, 2-anilino-3-methyl-6-N-methyl-N-(iso-propyl)amino fluoran, 2-anilino-3-methyl-6-N-methyl-N-pentyl amino fluoran, 2-anilino-3-methyl-6-N-methyl-N-cyclohexylamino fluoran, 2-anilino-3-methyl-6-diethylamino fluoran, 2-anilino-3-chloro-6-dimethylamino fluoran, 2-anilino-3-methyl-6-N-ethyl-N-isoamylamino fluoran, 2-anilino-3-methyl-6-N-methyl-N-isoamylamino fluoran, 2-anilino-3-chloro-6-diethylamino fluoran, 2-anilino-3-chloro-6-N-methyl-N-ethylamino fluoran, 2-anilino-3-chloro-6-N-methyl-N-(iso-propyl)amino fluoran, 2-anilino-3-chloro-6-N-methyl-N-pentylamino fluoran, 2-anilino-3-chloro-6-N-methyl-N-cyclohexylamino fluoran, 2-anilino-3-methyl-6-N-ethyl-N-pentylamino fluoran, 2-anilino-3-chloro-6-N-ethyl-N-pentylamino fluoran, 2-(p-methylanilino)-3-methyl-6-dimethylamino fluoran, 2-(p-methylanilino)-3-methyl-6-diethylamino fluoran, 2-(p-methylanilino)-3-methyl-6-N-methyl-N-ethylamino fluoran, 2-(p-methylanilino)-3-methyl-6-N-methyl-N-(iso-propyl)amino fluoran, 2-(p-methylanilino)-3-methyl-6-N-methyl-N-pentylamino fluoran, 2-(p-methylanilino)-3-methyl-6-N-methyl-N-cyclohexylamino fluoran, 2-(p-methylanilino)-3-methyl-6-N-ethyl-pentylamino fluoran, 2-(p-methylanilino)-3-chloro-6-dimethylamino fluoran, 2-(p-methylanilino)-3-chloro-6-diethylamino fluoran, 2-(p-methylanilino)-3-chloro-6-N-methyl-N-ethylamino fluoran, 2-(p-methylanilino)-3-chloro-6-N-methyl-N-(iso-propyl-)amino fluoran, 2-(p-methylanilino)-3-chloro-6-N-methyl-N-cyclohexylamino fluoran, 2-(p-methylanilino)-3-chloro-6-N-methyl-N-pentylamino fluoran, 2-(p-methylanilino-3-chloro-6-N-ethyl-N-pentylamino fluoran, 2-anilino-3-methyl-6-N-methyl-N-furylmethylamino fluoran and 2-anilino-3-ethyl-6-N-methyl-N-furylmethylamino fluoran. These electron donor dye precursors can be used singly. These electron donor dye precursors can also be used in combination to adjust color tone and inhibit discoloration of color images.

As the electron acceptor compound of the present invention there may be preferably used compounds of the general formulae (IV) to (VIII):

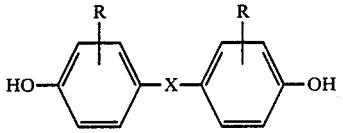

(IV)

wherein X represents S, O, $SO_2$, $S_2$ or

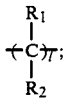

l represents an integer of 0 to 3; $R_1$ and $R_2$, which may be the same or different, each represents a hydrogen atom, $C_{1-8}$ alkyl group or a cycloalkyl group formed by connection of $R_1$ and $R_2$; and R, each of which may be the same or different, each represents a $C_{1-8}$ straight-chain or branched alkyl group or halogen atom.

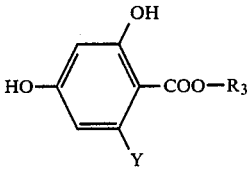

(V)

wherein Y represents a hydrogen atom, $-CH_3$ or $-OH$; and $R_3$ represents

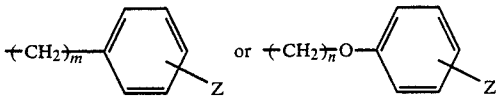

in which m represents an integer of 0 to 3; n represents an integer of 1 to 3; and Z represents a hydrogen atom, a halogen atom or $-CH_3$.

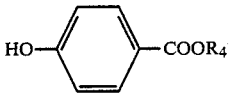

(VI)

wherein $R_4$ represents a benzyl group, a halogen atom or a benzyl group substituted by a $C_{1-8}$ straight-chain or branched alkyl group.

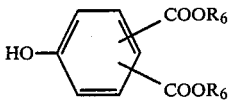

(VII)

wherein $R_6$ and $R_7$, which may be the same or different, each represents a $C_{1-8}$ alkyl group.

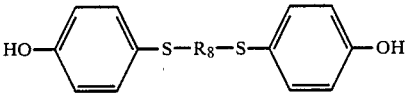

(VIII)

wherein $R_8$ represents an alkylene group having 1 to 5 ether bonds.

Specific examples of the compounds represented by the general formulas (IV) to (VIII) include 2,2-bis(4'-hydroxyphenyl)propane, 2,2-bis(4'-hydroxyphenyl)-pentane, 2,2-bis(4'-hydroxy-3',5'-dichlorophenyl)propane, 1-1-bis(4'-hydroxyphenyl)cyclohexane, 2,2-bis(4'-hydroxyphenyl)hexane, 1,1-bis(4'hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'- hydroxyphenyl)-2-methylpentane, 1,1-bis(4'-hydroxyphenyl)-2-ethyl-hexane, 1,1-bis(4'-hydroxyphenyl)dodecane, 3,3-bis(4-hydroxyphenyl)pentane, 1,2-bis(4'-hydroxyphenyl)ethane, 1,1-bis(4'-hydroxyphenyl)sulfide, 1,1-bis(4'-hydroxyphenyl)sulfone, 1,1-bis(4'-hydroxyphenyl)ether, 2,2-bis(4'-hydroxy-3',5'-dichlorophenyl)butane, 2,4-dihydroxyphenyl benzoate, 2,4-dihydroxy-4'-methylphenyl benzoate, 2,4-dihydroxy-4'-chlorophenyl benzoate, 2,4-dihydroxy-6-methylphenyl benzoate, 2,4,6-trihydroxyphenyl benzoate, 2,4-dihydroxy-6,4'-dimethylphenyl benzoate, 2,4-dihydroxy-6-methyl-4'-chlorophenyl benzoate, 2,4-dihydroxy-benzyl benzoate, 2,4-dihydroxy-4'-methyl benzyl benzoate, 2,4-dihydroxy-4'-chlorobenzyl benzoate, 2,4-dihydroxy-6-methyl benzyl benzoate, 2,4,6-trihydroxy benzyl benzoate, 2,4-dihydroxy-6,4'-dimethyl benzyl benzoate, 2,4-dihydroxy-6-methyl-4'-chloro benzyl benzoate, 4-hydroxy-ethyl ester benzoate, 4-hydroxy propyl ester benzoate, 4-hydroxy isopropyl ester benzoate, 4-hydroxy benzyl ester benzoate, 4-hydroxy-2-ethylhexyl ester benzoate, 4-hydroxy-4'-chloro benzyl ester benzoate, 4-hydroxy-4'-methyl benzyl ester benzoate, 4-hydroxy-4'-ethyl benzyl ester benzoate, 3-hydroxy-m-dimethyl phthalate, 3-hydroxy-m-diethyl phthalate, 3-hydroxy-m-methylethyl phthalate, 3-hydroxy-m-dibutyl phthalate, 3-hydroxy-o-dimethyl phthalate and 3-hydroxy-o-diethyl phthalate.

Furthermore, examples of the above general formulae include the following compounds:

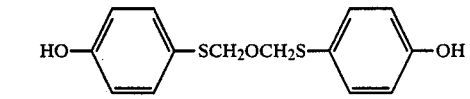
(I)

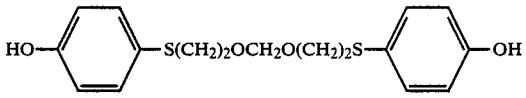
(II)

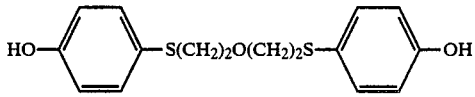
(III)

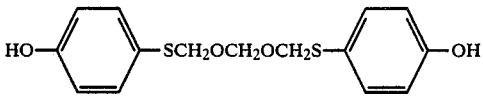
(IV)

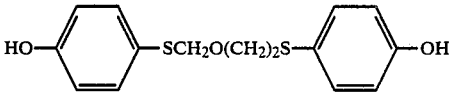
(V)

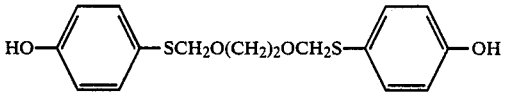
(VI)

Preferred examples of electron acceptor compounds other than those represented by the general formulae (IV) to (VIII) include bis-hydroxy cumylbenzene or bis-hydroxy-α-methylbenzylbenzene such as 1,4-bis-p-hydroxy cumyl benzene, 1,4-bis-m-hydroxy cumyl benzene, 1,3-bis-p-hydroxy cumyl benzene, 1,3-bis-3-m-hydroxy cumyl benzene, 1,4-bis-o-hydroxy cumyl benzene, 1,4-bis-p-hydroxy-α-methylbenzyl benzene and 1,3-bis-p-hydroxy-α-methylbenzyl benzene, salicylic acid derivatives such as 3,5-di-α-methylbenzyl salicyclic acid, 3,5-ditertiarybutyl salicyclic acid, 3-α,α-dimethylbenzyl salicylic acid, and polyvalent metal salts (most preferably zinc or aluminum) thereof, and phenol such as p-phenylphenol, 3,5-diphenyl phenol, and cumyl phenol. However, the present invention is not limited to these compounds.

The amount of the above electron acceptor compounds to be used is preferably about 50 to about 1,000% by weight, more preferably 100 to 500% by weight based on the weight of the electron donor dye precursor to be used. These electron acceptor compounds may be used singly or in combination.

In the heat-sensitive material of the present invention, a heat-fusible material may be incorporated in the heat-sensitive coloring layer in order to improve its heat response.

As suitable heat-fusible materials there may be used compounds of the general formulae (IX) to XIV):

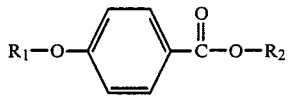
(IX)

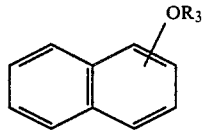
(X)

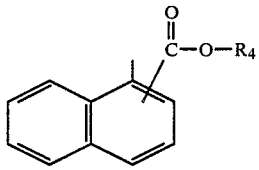
(XI)

$R_2NHCONH_2$ (XII)

$R_5CONH—R_7$ (XIII)

wherein $R_1$ to $R_4$, $R_1$ and $R_2$ being the same or different, each represents a phenyl group, benzyl group, or lower alkyl-, halogen-, hydroxy-, or alkoxy-substituted compounds thereof; $R_5$ and $R_6$ each represents an alkyl group having 12 to 24 carbon atoms; and $R_7$ represents a hydrogen atom or phenyl group.

If the phenyl group or benzyl group represented by $R_1$ to $R_4$ in the general formulae (IX) to (XI) is substituted by a lower alkyl group, the lower alkyl group has 1 to 8, preferably 1 to 3 carbon atoms. If the phenyl group or benzyl group is substituted by a halogen atom, the substituent halogen atom is preferably chlorine atom or fluorine atom.

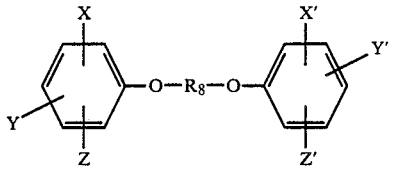
(XIV)

wherein $R_8$ represents a divalent group, preferably represents an alkylene group, alkylene group having ether bonds, alkylene group having carbonyl groups, alkylene group having halogen atoms or alkylene group having unsaturated bonds, more preferably represents an alkylene group or alkylene group having ether bonds; and X, Y, Z, X', Y', and Z', which may be the same or different, each represents a hydrogen atom, alkyl group, lower alkoxy group, lower aralkyl group, halogen atom, alkyloxycarbonyl group, or aralkyloxycarbonyl group.

The compounds of the general formulae (IX) to (XIV) preferably have a melting point of about 70° C. to about 150° C. More preferred melting point of these compounds is 80° C. to 130° C.

Specific examples of these compounds include p-benzyloxy benzyl benzoate, β-naphthylbenzyl ether, stearic acid amide, palmitic acid amide palmitate, N-phenyl stearic acid amide, N-stearyl urea, β-phenylesternaphthoate, 1-hydroxy-2-phenylesternaphthoate, β-naphthol(p-chlorobenzyl)ether, β-naphthol(p-methylbenzyl)ether, α-naththyl benzyl ether, 1,4-butanediol-p-methylphenyl ether, 1,4-propane diol-p-methylphenyl ether, 1,4-butane diol-p-isopropyl phenyl ether; 1,4-butane diol-p-t-octylphenyl ether, 2-phenoxy-1-p-tolyloxy-ethane, 1-phenoxy-2-(4-ethylphenoxy)ethane, 1-phenoxy-2-(4-chlorophenoxy)ethane and 1,4-butane diolphenyl ether.

The above mentioned heat-fusible materials may be used singly or in combination. In order to obtain a sufficient heat response, the heat-fusible materials are preferably used in an amount of at least about 10 to 20% by weight based on the weight of the electron acceptor compound. A more preferred amount fo the heat-fusible materials to be used is 20 to 150% by weight based upon the weight of the electron acceptor compound.

In a two-component system heat-sensitive recording material comprising an electron donor dye precursor and an electron acceptor compound, the recorded images are generally subject to discoloration due to outer conditions such as moisture and heat.

In the heat-sensitive recording material of the present invention, a discoloration inhibiting compound is preferably incorporated in the heat-sensitive coloring layer to inhibit such discoloration and render the image fast.

As such a discoloration inhibitor there may be effectively used a phenol derivative, particularly a hindered phenol compound. Examples of suitable discoloration inhibitors include compounds of the general formulae (XV) to (XVIII):

(XV)

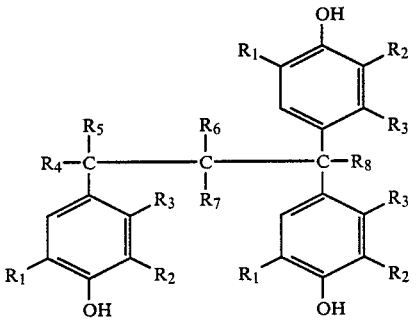

wherein $R_1$, each of which may be the same or diffrent, each represents a $C_{3-8}$ branched alkyl group; $R_2$, each of which may be the same or different, each represents a hydrogen atom or $C_{3-8}$ branched alkyl group; $R_3$, each of which may be the same or different, each represents a hydrogen atom or $C_{1-3}$ alkyl group; $R_4$ represents a hydrogen atom or $C_{1-8}$ alkyl group; $R_5$, $R_6$ and $R_7$, which may be the same or different, each represents a hydrogen atom or $C_{1-3}$ alkyl group; and $R_8$ represents a hydrogen atom or $C_{1-8}$ alkyl group.

(XVI)

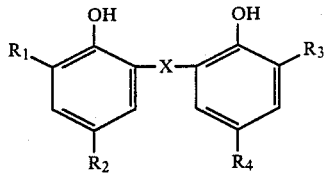

wherein $R_1$ and $R_3$, which may be the same or different, each represents a $C_{3-8}$ branched alkyl group; $R_2$ and $R_4$, which may be the same or different, each represents a $C_{1-8}$ alkyl group; X represents S, O, $SO_2$, $S_2$,

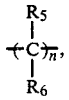

a cyclopentylene group or a cyclohexylene group; n represents an integer of 0 to 3; and $R_5$ and $R_6$, which may be the same or different, each represent a hydrogen atom or $C_{1-8}$ alkyl group.

(XVII)

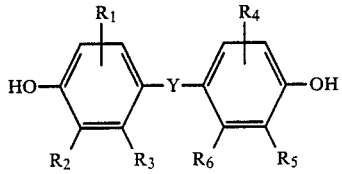

wherein $R_1$ and $R_4$, which may be the same or different, each represent a $C_{3-8}$ branched alkyl group; $R_2$, $R_3$, $R_5$ and $R_6$, which may be the same or different, each represent a hydrogen atom or $C_{1-8}$ alkyl group; Y represents S, O, $SO_2$, $S_2$, or

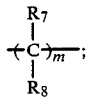

m represents an integer of 0 to 3; and $R_7$ and $R_8$, which may be the same of different, each represents a hydrogen atom or $C_{1-8}$ alkyl group or $R_7$ and $R_8$ are bonded to each other to form a cyclo pentamethylene group.

(XVIII)

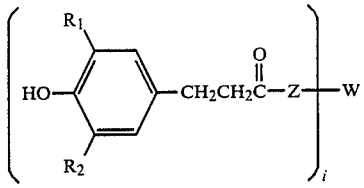

wherein $R_1$ and $R_2$, which may be the same or different, each represents a $C_{3-8}$ branched alkyl group; Z represents —NH— or —$O(CH_2)_n$— in which n represents an integer of 1 to 5; and i represents an integer of 1 to 4, wherein when i=1 W represents a $C_{1-18}$ alkyl group, when i=2 W represents S, O, or

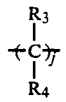

in which $R_3$ and $R_4$, which may be the same or different, each represent a hydrogen atom or $C_{1-8}$ alkyl group and j represents O or an integer of 1 to 8, when i=3 W represents ≡C—$R_5$ represents a hydrogen atom or $C_{1-8}$ alkyl group and when i=4 W represents

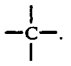

Typical examples of the phenol derivatives of the general formulae (XV) to (XVIII) are described hereinafter.

(A) Examples of the phenol derivatives of the general formula (XV) include 1,1,3-tris(2-methyl-4-hydroxy-5-tert-butylphenyl)butane, 1,1,3-tris(2-ethyl-4-hydroxy-5-tert-butylphenyl)butane, 1,1,4-tris(3,5-di-tert-butyl-4-hydroxyphenyl)butane and 1,1,3-tris(2-methyl-4-hydroxy-5-tert-butylphenol)propane.

(B) Examples of the phenol derivatives of the general formula (XVI) include 2,2'-methylene-bis(6-tert-butyl-4-methylphenol) and 2,2'-methylene-bis(6-tert-butyl-4-ethylphenol).

(C) Examples of the phenol derivatives of the general formula (XVII) include 4,4'-butylidene-bis(6-tert-butyl-3-methylphenol) and 4,4'-thio-bis(3-methyl-6-tert-butylphenol).

(D) Examples of the phenol derivatives of the general formula (XVIII) include:

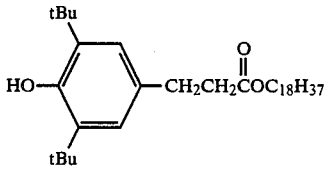

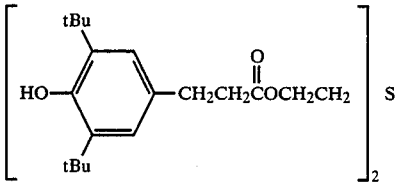

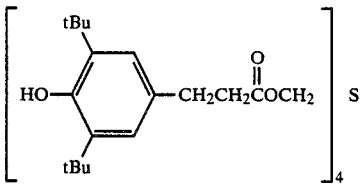

The phenol compounds of the general formulae (XV) to (XVIII) are preferably used in an amount of about 1 to about 200% by weight based on the weight of the electron acceptor compound. A more preferred amount of the phenol compounds to be used is 5 to 50% by weight.

In addition to the modified polyvinyl alcohol of the present invention or a mixture of the modified polyvinyl alcohol and a starch, a water-soluble high polymer may be incorporated in the recording layer of the heat-sensitive material of the present invention.

As these binders there may be preferably used compounds which are soluble in water at a temperature of 25° C. in a proportion of at least 5% by weight thereof. Specific examples of such compounds include methyl cellulose, carboxy methyl cellulose, hydroxy ethyl cellulose, starch, gelatin, gum arabic, casein, hydrolyzate of styrene-maleic anhydrous copolymer, hydrolyzate of ethylene-maleic anhydrous copolymer, hydrolyzate of isobutylene-maleic anhydrous copolymer, polyvinyl alcohol, carboxy-modified polyvinyl alcohol and polyacrylamide.

A pigment, water-insoluble binder, metal soap, wax, surface active agent or the like may be optionally incorporated in the recording layer of the heat-sensitive recording material of the present invention.

As such a pigment there may be used zinc oxide, calcium carbonate, barium sulfate, titanium oxide, lithopone, talc, agalmatolite, kaolin, aluminum hydroxide, silica, or amorphous silica.

As such a water-insoluble binder there may be generally used a synthetic rubber latex or synthetic resin emulsion. Examples of such a latex or emulsion include styrene-butadiene rubber latex, acrylonitrile-butadiene rubber latex, methyl acrylate-butadiene rubber latex and vinyl acetate emulsion.

As such a metal soap there may be used higher aliphatic acid metal salts. Examples of such metal soaps include emulsions of zinc stearate, calcium stearate, aluminum stearate, etc.

Example of waxes which may be used include emulsions of paraffin wax, microcrystalline wax, carnauba wax, methylol stearo amide, polyethylene wax and polystyrene wax, etc.

As such surface active agents there may be used sulfosuccinic acid alkali metal salts and fluorine-containing surface active agents.

The present invention will be further illustrated in the following examples but should not be construed as being limited thereto. In the following examples all percentages, ratios, etc. are by weight, unless otherwise specified.

EXAMPLES

Modified polyvinyl alcohols of the present invention, shown in Table 1, were prepared in accordance with the process as described in Japanese Patent Publication No. 42724/72.

TABLE 1

| Modified PVA No. | Content of acrylamide (mol. %) | Degree of saponification (mol. %) | Average polymerization degree | Content of carboxyl group (mol. %) |
|---|---|---|---|---|
| 1 | 1 | 99 | 1200 | 1 |
| 2 | 5 | 99 | 1200 | 1 |
| 3 | 20 | 99 | 1200 | 1 |
| 4 | 70 | 99 | 1200 | 1 |
| 5 | 20 | 99 | 500 | 3 |
| 6 | 10 | 88 | 1200 | 3 |
| 7 | 20 | 88 | 1700 | 5 |
| 8 | 50 | 88 | 1700 | 3 |
| 9 | 20 | 88 | 500 | 5 |

Materials used for the heat-sensitive coloring layer of the present invention are shown in Table 2. 20 g of the electron donor dye precursors, electron acceptor compounds, heat-fusible materials, discoloration inhibitors were each separately subjected to dispersion together with 100 g of 5% aqueous solution of polyvinyl alcohol (Kurare PVA-105) overnight by means of a ball mill so that the average particle diameter thereof reached 3 μm or less. 80 g of the pigments each was subjected to dispersion together with 160 g of 0.5% solution of sodium hexametaphosphorate by means of a homogenizer before use. The dispersions thus obtained were mixed with each other in a mixing ratio of 5 g of electron donor dye precursor dispersion, 10 g of electron acceptor compound dispersion, 2 g of discoloration inhibitor dispersion and 22 g of pigment dispersion. Furthermore, 3 g of 21% zinc stearate emulsion and 5 g of 2% sodium di(2-ethylhexyl)sulfosuccinate aqueous solution were added to the admixture to obtain a coating fluid. The coating fluid thus obtained was applied to a fine paper with a weight of 50 g/m$^2$ in an amount calculated in terms of dried weight of 5 g/m$^2$ by means of a wire bar. The coating fluid thus applied was then dried at a temperature of 50° C. in an oven to obtain heat-sensitive coloring layers (A) to (J) as shown in Table 2.

EXAMPLES 1 TO 12

A coating fluid which had been prepared by mixing 100 g of a 5% solution of the present modified polyvinyl alcohol shown in Table 1 with 15 g of a dispersion of the pigment shown in Table 3 (prepared in the same manner as used in the preparation of the pigment dispersion for the above heat-sensitive coloring layer), 20 g of a 5% solution of a waterproofing agent, 4 g of a 21% emulsion of zinc stearate, and 1 g of a 2% aqueous solution of sodium di-(2-ethylhexyl)sulfosuccinate was applied to the heat-sensitive coloring layer specified in Table 3 thus prepared by means of a wire bar in an amount calculated in terms of dried weight of 2 g/m$^2$. The coating fluid thus applied was then dried at a temperature of 50° C. in an oven. The coat thus dried was then supercalendered in such a manner that the Bekk smoothness of the surface thereof was 800 sec. or more to obtain the present heat-sensitive recording materials.

EXAMPLES 12 TO 27

A coating fluid which had been prepared by mixing 50 g of a 5% solution of the present modified polyvinyl alcohol shown in Table 1 with 50 g of an aqueous solution of a starch (its concentration is shown in Table 4, 15 g of a pigment dispersion (prepared in the same manner as used in the preparation of the pigment dispersion for the above heat-sensitive coloring layer), 20 g of a 5% solution of a waterproofing agent, 4 g of a 21% zinc stearate emulsion, and 1 g of a 2% aqueous solution of sodium di-(2-ethylhexyl)sulfosuccinate was applied to the heat-sensitive coloring layer specified in Table 3 thus prepared by means of a wire bar in an amount calculated in terms of dried weight of 2 g/m$^2$. The coating fluid thus applied was then dried at a temperature of 50° C. in an oven. The coat thus dried was then supercalendered in such a manner that the Bekk's smoothness of the surface there was 800 sec. or more to obtain the present heat-sensitive recording materials.

COMPARATIVE EXAMPLES 1 TO 10

The heat-sensitive layers used were prepared in the same manner described above with respect to the Examples. A coating fluid which had been prepared by mixing 100 g of a 5% solution of a water-soluble polymer, other than the present water-soluble polymer shown in Table 5, with 15 g of a pigment dispersion (prepared in the same manner as in the Examples), 20 g of a 5% solution of a water-proofing agent, 4 g of a 21% zinc stearate emulsion, and 1 g of a 2% solution of a fluorine-containing anionic surface active agent was applied to the heat-sensitive coloring layers described in Table 2 thus prepared by means of a wire bar in an amount calculated in terms of dried weight of 2 g/m$^2$. The coating fluid thus applied was then dried at a temperature of 50° C. in an oven. The coat thus dried was then supercalendered in such a manner that the Bekk's smoothness of the surface thereof was 800 sec. or more to obtain comparative heat-sensitive materials.

The color density was determined by measuring the density of a copy of Test Chart No. 3 (published by GAZO DENSHI GAKKAI) reproduced through MATSUSHITA DENSO K.K.'s high speed facsimile UF-2. The measurement was conducted by means of Macbeth's RD-918 densitometer.

The solvent resistance was determined by measuring the degree of fog developed on the coloring surface of the heat-sensitive recording material when laminated with filter papers impregnated with ethanol, toluene or methyl Cellosolve. The heat-sensitive recording material's property of running through a facsimile apparatus was determined by continuously copying Test Chart No. 2 (published by GAZO DENSHI GAKKAI) on 100 or more sheets of the specimen using MATSUSHITA DENSO K.K.'s high speed facsimile UF-2. The specimen's adaptability as stationary was determined by observing ink run and drying on printed portions and background of the coloring surface of the heat-sensitive recording material when tested by a water ink pen and an oil ink pen. The keeping quality of image on printed portions was determined by eye.

The results are shown in Table 6.

TABLE 2

| Heat-sensitive layer | Electron donor dye precursor | Electron acceptor compound | Heat-fusible material | Discoloration inhibitor | Pigment |
|---|---|---|---|---|---|
| A | Crystal violet lactone | 2,2-bis(p-hydroxy penyl)propane | Amide stearate | None | Calcium carbonate* |
| B | 2-anilino-3-chloro-6-diethylamino fluoran | Same as above | Same as above | None | Same as above |
| C | Mixture of equal amount (wt.) of 2-anilino-3-chloro-6-diethylamino fluoran and 2-anilino-3-methyl-6-N—methyl-N—cyclohexylamino | Same as above | β-naphthylbenzyl ether | None | Same as above |

TABLE 2-continued

| Heat-sensitive layer | Electron donor dye precursor | Electron acceptor compound | Heat-fusible material | Discoloration inhibitor | Pigment |
|---|---|---|---|---|---|
| | fluoran | | | | |
| D | Mixture of equal amount (wt.) of 2-anilino-3-chloro-6-diethylamino fluoran and 2-anilino-3-methyl-6-N—ethyl-N—iso-amylamino fluoran | Same as above | 1-hydroxy-2-phenyl ester naphthoate | 1,1,3-tris (2-methyl-4-hydroxy-5-tert-butylphenyl-butane | Same as above |
| E | Mixture of equal amount (wt.) of 2-anilino-3-chloro-6-diethylamino fluoran and 2-anilino-3-methyl-6-N—ethyl-N—furyl-methylamino fluoran | 1,1-bis(4'-hydroxy phenyl)cyclohexane | 1-phenoxy-2-(4-ethylphenoxy) ethane | Same as above | Calcined kaolin** |
| F | Mixture of equal amount (wt.) of 2-anilino-3-chloro-6-diethylamino fluoran and 2-anilino-3-methyl-6-N—ethyl-N—iso-amylamino fluoran | 1,4-bis(p-hydroxy cumyl)benzene | β-naphthylbenzyl ether | 1,1,3-tris(2-methyl-4-hydroxy-5-tert-butyl phenyl | Calcined kaolin** |
| G | 2-anilino-3-methyl-6-N—methyl-N—cyclohexylamino fluoran | 4-hydroxy benzyl benzoate | None | 2,2'-methylene-bis-(6-tert-butyl-4-methyl phenol) | Aluminum hydroxide*** |
| H | 2-anilino-3-methyl-6-N—methyl-N—cyclohexylamino fluoran | Same as above | 1-hydroxy-2-phenyl ester naphthoate | 4,4'-thio-bis-(3-methyl-6-tert-butylphenol) | Calcium carbonate* |
| I | Mixture of equal amount (wt.) of 2-anilino-3-chloro-6-diethylamino fluoran and 2-anilino-3-methyl-6-N—ethyl-N—furyl-methylamino fluoran | 2-hydroxy-o-dimethyl phthalate | Same as above | 1,1,3-tris(2-methyl-4-hydroxy-5-tert-butyl phenyl)butane | Amorphous silica # |
| J | 2-anilino-3-methyl-6-N—methyl-cyclo-hexylamino fluoran | Bis-(2-(4-hydroxy phenylthio)ethoxy) methane | 1-phenoxy-2-(4, ethoxyphenoxy) ethane | 4,4'-butylidene-bis (6-tert-butyl-3-methyl phenol) | Calcium carbonate* |
| K | Mixture of equal amount (wt.) of 2-anilino-3-chloro-6-diethylamino fluoran and 2-anilino-3-methyl-6-N—methyl-N—cyclo-hexylamino fluoran | 1,1-bis(4'-hydroxy phenyl)cyclohexane | β-naphthylbenzyl ether | 1,1,3-tris(2-methyl-4-hydroxy-5-tert-butyl phenyl)butane | Calcium carbonate* |

Notes
*Calcium carbonate . . . SHIRAISHI KOGYOSHA Brilliant-15
**Calcined kaolin . . . Engerhalt Ansilex-93
***Aluminum hydroxide . . . SHOWA KEIKINZOKU K.K. Hidilite-H42M
Amorphous silica . . . MIZUSAWA KAGAKUSHA Mizucasil P-527

TABLE 3

| Example No. | Modified PVA (from Table 1) | Coloring layer (From Table 2) | Pigment used in protective layer (Note 1) | Waterproofing Agent (Note 2) |
|---|---|---|---|---|
| 1 | No. 1 | A | Aluminum hydroxide | Boric acid |
| 2 | No. 2 | B | Calcium carbonate | Trimethylol melamine |
| 3 | No. 3 | C | Kaolin | None |
| 4 | No. 3 | E | Kaolin | Melamine-formalin resin |
| 5 | No. 4 | D | Calcined kaolin | Broci acid |
| 6 | No. 5 | F | Kaolin | Glyoxal |
| 7 | No. 6 | G | Kaolin | Melamine-formalin resin |
| 8 | No. 7 | H | Aluminum hydroxide | Glyoxal |
| 9 | No. 7 | I | Kaolin | Glyoxal |
| 10 | No. 8 | J | Amorphous silica | Urea-formalin resin |
| 11 | No. 8 | K | Kaolin | None |

TABLE 3-continued

| Example No. | Modified PVA (from Table 1) | Coloring layer (From Table 2) | Pigment used in protective layer (Note 1) | Waterproofing Agent (Note 2) |
|---|---|---|---|---|
| 12 | No. 9 | K | Kaolin | Melamine-formalin resin |

Note 1:
Aluminum hydroxide . . . SHOWA KEIKINZOKU K.K. Hidilite H42M
Calcium carbonate . . . SHIRAISHI KOGYOSHA K.K. Brilliant 15
Kaolin . . . Kaobright
Calcined kaolin . . . Engerhalt Ansilex 93
Amorphous silica . . . MIZUSAWA KAGAKUSHA K.K. Mizucasil P-527
Note 2:
Melamine-formalin resin . . . SUMITOMO KAGAKUSHA Sumilet Resin #613
Urea-formalin resin . . . SUMITOMO KAGAKUSHA Sumitex Resin H-90

TABLE 4

| Example No. | Modified PVA No. (From Table 2) | Coloring layer (From Table 2) | Pigment used in protective layer (Note 1) | Starch | Concentration (%) | Waterproofing agent |
|---|---|---|---|---|---|---|
| 13 | No. 1 | A | Calcium carbonate | Oxidized | 10 | Glyoxal |
| 14 | No. 2 | B | Calcium carbonate | Phosphoric-esterified | 10 | Glyoxal |
| 15 | No. 3 | C | Kaolin | Oxidized | 10 | Glyoxal |
| 16 | No. 3 | K | Kaolin | Etherified | 10 | None |
| 17 | No. 3 | D | Calcined kaolin | Crosslinked | 15 | None |
| 18 | No. 4 | F | Kaolin | Oxidized | 15 | Melamine-formalin resin |
| 19 | No. 5 | G | Kaolin | Oxidized | 20 | Melamine-formalin resin |
| 20 | No. 6 | H | Calcium carbonate | Graft | 20 | Melamine-formalin resin |
| 21 | No. 7 | I | Kaolin | Oxidized | 30 | Urea-formalin resin |
| 22 | No. 7 | J | Amorphous silica | Etherified | 30 | Urea-formalin resin |
| 23 | No. 7 | K | Kaolin | Graft | 10 | Urea-formalin resin |
| 24 | No. 8 | C | Kaolin | Etherified | 10 | Boric acid |
| 25 | No. 8 | K | Kaolin | Graft | 10 | Boric acid |
| 26 | No. 9 | K | Kaolin | Oxidized | 10 | Glyoxal |
| 27 | No. 9 | K | Kaolin | Graft | 10 | Glyoxal |

Notes 1 and 2:
same as that shown in Table 3.

TABLE 5

| Comparative Example No. | Coloring layer (Table 2) | Water-soluble polymer used in protective layer (Note 3) | Pigment used in protective layer (Note 1) | Waterproofing agent (Note 2) |
|---|---|---|---|---|
| 1 | A | Oxidized starch | Kaolin | Glyoxal |
| 2 | B | Sodium starch | Kaolin | Glyoxal |
| 3 | C | Fully saponified polyvinyl alcohol (polymerization degree: 1700) | Kaolin | Boric acid |
| 4 | D | Partially saponified polyvinyl alcohol (polymerization degree: 1700; saponification degree: 88%) | Calcium carbonate | Melamine-formalin resin |
| 5 | E | Sodium salt of diisobutylenemaleic acid copolymer | Silica | Polyamide resin |
| 6 | F | Polyacrylamide | Kaolin | None |
| 7 | G | 1:1 mixture of carboxyl-modified polyvinyl alcohol and diisobutylene-maleic acid copolymer sodium salt | Silica | Polyamide resin |
| 8 | H | Fully saponified polyvinyl alcohol | Kaolin | Boric acid |
| 9 | I | Crosslinked starch | Aluminum hydroxide | Glyoxal |
| 10 | J | Oxidized starch | Kaolin | Glyoxal |

Notes 1 and 2:
same as that shown in Table 3
Note 3:

TABLE 6

| | | Solvent Resistivity | | | | Running Through Facsimile | | | Adaptability to Stationery | | |
|---|---|---|---|---|---|---|---|---|---|---|---|
| No. | Color Density | $C_2H_5OH$ | Toluene | Methyl Cellosolve | | Sticking | Running Sound | Stain on Head | Ink Run | Ink Drying | Image Preservability |
| Ex. 1 | 1.12 | ○ | ○ | ○ | ○ | ○ | ◎ | ○ | ○ | ○ | |
| Ex. 2 | 1.18 | ◎ | ○ | ○ | ○ | ○ | ◎ | ○ | ○ | ○ | |
| Ex. 3 | 1.30 | ○ | ○ | ○ | ○ | ○ | ○ | ○ | ○ | ○ | |

TABLE 6-continued

| No. | Color Density | Solvent Resistivity | | | | Running Through Facsimile | | | Adaptability to Stationery | | |
|---|---|---|---|---|---|---|---|---|---|---|---|
| | | $C_2H_5OH$ | | Toluene | Methyl Cellosolve | Sticking | Running Sound | Stain on Head | Ink Run | Ink Drying | Image Preservability |
| Ex. 4 | 1.25 | ◎ | ○ | ◎ | ○ | ○ | ◎ | ○ | | ○ | ○ |
| Ex. 5 | 1.25 | ○ | ○ | ○ | ○ | ○ | ◎ | ○ | | ○ | ○ |
| Ex. 6 | 1.30 | ◎ | ○ | ◎ | ◎ | ○ | ○ | ○ | | ○ | ○ |
| Ex. 7 | 1.32 | ○ | ○ | ○ | ○ | ○ | ◎ | ○ | | ○ | ◎ |
| Ex. 8 | 1.35 | ○ | ○ | ○ | ○ | ○ | ◎ | ○ | | ○ | ○ |
| Ex. 9 | 1.28 | ○ | ○ | ○ | ○ | ○ | ◎ | ○ | | ○ | ○ |
| Ex. 10 | 1.25 | ○ | ○ | ○ | ○ | ○ | ◎ | ○ | | ○ | ◎ |
| Ex. 11 | 1.30 | ◎ | ○ | ○ | ◎ | ◎ | ◎ | ○ | | ○ | ◎ |
| Ex. 12 | 1.30 | ◎ | ◎ | ◎ | ◎ | ◎ | ◎ | ○ | | ○ | ○ |
| Ex. 13 | 1.10 | ○ | ○ | ○ | ○ | ○ | ○ | ○ | | ○ | ○ |
| Ex. 14 | 1.16 | ○ | ○ | ○ | ◎ | ◎ | ○ | ○ | | ○ | ○ |
| Ex. 15 | 1.32 | ○ | ○ | ○ | ◎ | ◎ | ○ | ○ | | ○ | ○ |
| Ex. 16 | 1.25 | ○ | ○ | ○ | ◎ | ◎ | ○ | ○ | | ○ | ○ |
| Ex. 17 | 1.28 | ○ | ○ | ○ | ◎ | ◎ | ○ | ○ | | ○ | ◎ |
| Ex. 18 | 1.30 | ◎ | ○ | ○ | ◎ | ◎ | ○ | ○ | | ○ | ○ |
| Ex. 19 | 1.24 | ○ | ○ | ○ | ◎ | ◎ | ○ | ○ | | ○ | ○ |
| Ex. 20 | 1.26 | ○ | ○ | ○ | ○ | ○ | ○ | ○ | | ○ | ○ |
| Ex. 21 | 1.32 | ○ | ○ | ○ | ◎ | ◎ | ○ | ○ | | ○ | ○ |
| Ex. 22 | 1.33 | ○ | ○ | ○ | ○ | ○ | ○ | ○ | | ○ | ○ |
| Ex. 23 | 1.20 | ◎ | ◎ | ○ | ◎ | ◎ | ◎ | ○ | | ○ | ○ |
| Ex. 24 | 1.25 | ○ | ○ | ○ | ○ | ○ | ○ | ○ | | ○ | ○ |
| Ex. 25 | 1.27 | ◎ | ○ | ○ | ◎ | ◎ | ◎ | ○ | | ○ | ○ |
| Ex. 26 | 1.28 | ◎ | ○ | ○ | ◎ | ◎ | ◎ | ○ | | ○ | ◎ |
| Ex. 27 | 1.30 | ◎ | ◎ | ○ | ◎ | ◎ | ◎ | ○ | | ○ | ◎ |
| Comp. Ex. 1 | 1.15 | X | | X | X | ○ | ○ | X | Δ | Δ | X |
| Comp. Ex. 2 | 1.10 | ◎ | | ○ | Δ | Δ | ○ | X | Δ | Δ | ○ |
| Comp. Ex. 3 | 1.20 | ○ | | ○ | ○ | Δ | X | ○ | X | X | ○ |
| Comp. Ex. 4 | 1.22 | Δ | | Δ | Δ | X | Δ | ○ | | X | ○ |
| Comp. Ex. 5 | 1.15 | Δ | | X | Δ | X | X | Δ | | Δ | ○ |
| Comp. Ex. 6 | 1.25 | Δ | | Δ | Δ | Δ | Δ | Δ | Δ | Δ | Δ |
| Comp. Ex. 7 | 1.27 | Δ | | Δ | Δ | Δ | Δ | Δ | X | X | ○ |
| Comp. Ex. 8 | 1.27 | ○ | | ○ | ○ | Δ | X | ○ | X | X | ○ |
| Comp. Ex. 9 | 1.26 | X | | X | X | ○ | ○ | X | Δ | Δ | X |
| Comp. Ex. 10 | 1.26 | X | | X | X | ○ | ○ | X | Δ | Δ | X |

(Note)
◎. . . Very excellent
○ . . . No problem in practical use
Δ . . . May cause trouble in practical use
X . . . Very poor (causes trouble)

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having coated thereon a heat-sensitive coloring layer containing a colorless or light-colored electron donating dye precursor and an electron accepting compound capable of reacting with said electron donating dye precursor to form a color and a protective layer provided on said heat-sensitive coloring layer comprising a saponified product of a vinyl acetate-acrylamide copolymer or vinyl acetate-methacrylamide copolymer having an acrylamide or methacrylamide content of about 0.5 to about 80% by weight.

2. A heat-sensitive recording material as claimed in claim 1, wherein the saponification degree of said copolymer is in the range of about 60 to about 100%.

3. A heat-sensitive recording material as claimed in claim 1, wherein the average degree of polymerization of said copolymer is in the range of about 100 to about 3,000.

4. A heat-sensitive recording material as claimed in claim 1, wherein said protective layer contains a starch together with said copolymer.

5. A heat-sensitive recording material as claimed in claim 4, wherein the starch is a modified starch selected from the group consisting of an oxidized starch, cross-linked starch, graft starch, esterified starch and etherified starch and the protective layer further comprises a pigment selected from the group consisting of zinc oxide, calcium carbonate, barium sulfate, titanium oxide, lithopone, talc, agalmatolite, kaolin, aluminum hydroxide, silica, amorphous silica and colloidal silica in an amount of 0.5 to 4 times the total weight of the starch and the saponified product of a vinyl acetate-acrylamide copolymer or vinylacetate-methacrylamide copolymer.

6. A heat-sensitive recording material as claimed in claim 1, wherein the colorless or light-colored electron donating dye precursor is selected from the group consisting of triaryl methane compounds, diphenyl methane compounds, xanthene compounds, thiazine compounds and spiropyran compounds.

7. A heat-sensitive recording material as claimed in claim 1, wherein the electron donor dye precursor is an xanthene compound represented by the general formula (II):

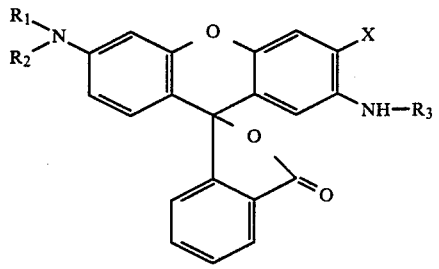

(II)

wherein $R_1$ and $R_2$, which may be the same or different, each represents a $C_{1-10}$ alkyl group or cycloalkyl group; $R_3$ represents an aryl group; and X represents a $C_{1-10}$ alkyl group or halogen atom.

8. A heat-sensitive recording material as claimed in claim 1, wherein the electron acceptor compound is selected from the group consisting of compounds of the general formula (IV) to (VIII):

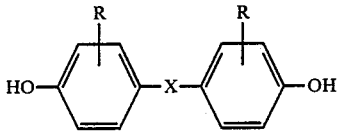

(IV)

wherein X represents S, O, $SO_2$ or

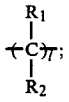

l represents an integer of 1 to 3; $R_1$ and $R_2$, which may be the same or different, each represents a hydrogen atom, a $C_{1-8}$ alkyl group or cycloalkyl group formed by connection of $R_1$ and $R_2$; and R, each of which may be the same or different, each represents a $C_{1-8}$ straight-chain or branched alkyl group or a halogen atom;

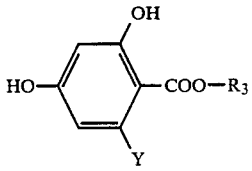

(XV)

wherein Y represents a hydrogen atom, $-CH_3$ or $-OH$, and $R_3$ represents:

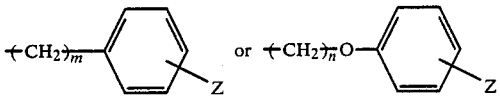

in which m represents an integer of 0 to 3; n represents an integer of 1 to 3; and Z represents a hydrogen atom, a halogen atom or $-CH_3$;

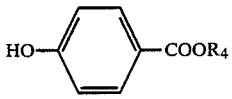

(VI)

wherein $R_4$ represents a benzyl group, a halogen atom or a benzyl group substituted by a $C_{1-8}$ straight chain or branched alkyl group;

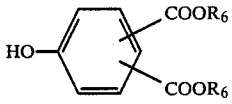

(VII)

wherein $R_6$ and $R_7$, which may be the same or different, each represents an alkyl group containing 1 to 8 carbon atoms; and

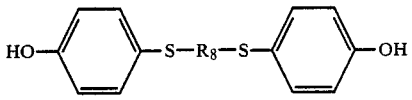

(VIII)

wherein $R_8$ represents an alkylene group having 1 to 5 ether bonds.

9. A heat-sensitive recording material as claimed in claim 1, wherein the electron acceptor compound is contained in an amount of about 50 to about 1,000% by weight based on the weight of the electron donor dye precursor.

10. A heat-sensitive recording material as claimed in claim 1, wherein the electron acceptor compound is contained in an amount of 100 to 500% by weight based on the weight of the electron donor dye precursor.

11. A heat-sensitive recording material as claimed in claim 1, wherein the heat-sensitive coloring layer contains a binder selected from the group consisting of methyl cellulose, carboxy methyl cellulose, hydroxy ethyl cellulose, starch, gelatin, gum arabic, casein, hydrolyzate of styrene-maleic anhydrous copolymer, hydrolyzate of ethylene-maleic anhydrous copolymer, polyvinyl alcohol, carboxy-modified polyvinyl alcohol and polyacrylamide.

* * * * *